US007490873B1

(12) United States Patent
Ricke et al.

(10) Patent No.: US 7,490,873 B1
(45) Date of Patent: Feb. 17, 2009

(54) TILT LATCH/SASH LOCK ASSEMBLY FOR WINDOWS

(75) Inventors: Larry Ricke, Parkersburg, IA (US); Mark Ricke, Parkersburg, IA (US)

(73) Assignee: Ultra, LLC, Waterloo, IA (US)

( * ) Notice: Subject to any disclaimer, the term of this patent is extended or adjusted under 35 U.S.C. 154(b) by 275 days.

(21) Appl. No.: 11/162,590

(22) Filed: Sep. 15, 2005

(51) Int. Cl.
*E05C 5/00* (2006.01)

(52) U.S. Cl. ..... 292/5; 292/DIG. 47; 49/449

(58) Field of Classification Search ..... 292/241, 292/5, 242, DIG. 47; 49/176, 180, 181, 183–185, 49/187, 188, 449
See application file for complete search history.

(56) References Cited

U.S. PATENT DOCUMENTS 5,090,750 A 2/1992 Lindqvist
5,139,291 A * 8/1992 Schultz ..... 292/42
5,398,447 A 3/1995 Morse
5,992,907 A * 11/1999 Sheldon et al. ..... 292/34
6,546,671 B2 4/2003 Mitchell et al.
2003/0084614 A1 5/2003 Pettit et al.
2004/0168370 A1 * 9/2004 Pettit et al. ..... 49/185

* cited by examiner

*Primary Examiner*—Gary Estremsky
(74) *Attorney, Agent, or Firm*—Ryan N. Carter; Jason R. Sytsma

(57) ABSTRACT

A latch assembly comprising a tilt latch mechanism and a sash lock mechanism for a vinyl window that is slidable and tiltable. The latch assembly comprises a lever movable among a first, a second, and a third position to adjust the assembly among a respective locked, unlocked, and tiltable position. In the locked position, a portion of a rotor engages a keeper to prevent the window from being able to move. In the unlocked position, the window is movable upward and downward along the rails of the window frame. In the tiltable position, the window may be tilted on an axis to allow for cleaning the outer portion of the window from inside the house.

9 Claims, 7 Drawing Sheets

TILT LATCH/SASH LOCK ASSEMBLY FOR WINDOWS

BACKGROUND OF THE INVENTION

The present invention relates generally to sash window hardware and, more particularly, to an integrated tilt latch and sash lock assembly that performs a sash lock operation and a tilt-latch operation in a vinyl window.

Sash window assemblies are well-known. In one typical configuration, a sash window is slidably supported within a master frame. The master frame of the sash window assembly typically has opposed, vertically extending guide rails to enable vertical reciprocal sliding movement of the sash window while cooperatively engaged with the guide rails. The sash window has a top sash rail, a base, and a pair of stiles cooperatively connected together at adjacent extremities thereof to form a sash frame, usually a rectangular frame. In another conventional configuration, a double-hung sash window assembly has a lower sash window and an upper sash window that are mounted for slidable movement along adjacent parallel guide rails in the master frame. To restrain upward sliding of the lower sash window, the sash window assembly typically employs a sash lock assembly generally consisting of a rotor and a keeper. When it is desirable to lock the window to prevent upward sliding, an operator rotates the rotor to engage the keeper.

The sash windows in these sash window assemblies are often constructed to allow for the sash windows to be tilted inward. This allows, for example, a homeowner to easily clean an outer surface of a glass pane of the sash window from inside of a dwelling. To allow for tilting, the sash window is pivotally mounted in the master frame at the base of the sash window, and the sash window is equipped with a tilt-latch. Typically, a tilt-latch is installed in opposite ends of the top rail of the sash window. The tilt-latches have a latch bolt that is biased outwardly for engagement with guide rails of the master frame. An operator manually engages the latch bolts and simultaneously retracts each latch bolt into the top rail. Once retracted, the latch bolts are then disengaged from the guide rails wherein the sash window can then be titled inward. In this configuration, an operator must use two hands to inwardly pivot the sash window since the latch bolts are required to be simultaneously retracted. This simultaneous retraction can be difficult for some operators. In addition, certain sash lock and tilt-latch designs have had an assortment of complex structures that are expensive and difficult to assemble and operate.

Windows of this type are made out of different materials. Two common materials are wood and vinyl. Some attempts have been made to provide an assembly that has a single actuator that operates both the sash lock and tilt-latch in wood windows; however, Applicant is unaware of any such single-actuator assemblies in vinyl windows. U.S. Pat. No. 6,546,671 and U.S. patent application Ser. Nos. 10/747,859; 10/290,037 are some examples of such single-actuator assemblies in wood windows. One problem with these designs is that they are not adapted to be inserted into vinyl windows. Yet another problem with these designs is that they are complex and expensive to manufacture and to maintain due to the fact they must be inserted into solid wood window frames. Another problem with these designs is that the various actuator parts can come out of alignment through the repeated opening and closing of the window.

There is therefore a need for a tilt latch/sash lock design that is simple and sturdy in construction, easily combines to a vinyl window frame, and provides smooth, reliable operation.

SUMMARY OF THE INVENTION

The present invention is a latch assembly comprising a tilt latch mechanism and a sash lock mechanism for use with vinyl sash windows that are both slidable and tiltable. The window assembly comprises a master frame with an upper sash window and a lower sash window movably mounted therein. The sash windows have an open position, a closed position, and a tilted position. Each sash window comprises a sash window frame which is disposed in a sliding engagement in the master window frame. A portion of each sash frame is pivotally combined with the master window frame so that the sash frames can pivot on an axis relative to master window frame. Attached to a lower edged of the upper sash frame is at least one keeper while the latch assembly is attached to an upper edge of the lower sash frame.

The latch assembly generally comprises a sash lock housing and a latch bolt housing combined by a support member and a latch bolt. A lever is combined with the sash lock housing. The lever is movable among a first, a second, and a third position to adjust the assembly among the respective locked, unlocked, and tiltable position. The lever has a handle end that extends upward from the top of the housing and an extension portion that extends through the housing to combine with a rotor so that movement of the lever causes movement of the rotor. The rotor is adapted to engage the keeper when the lever is moved to the locked position so as to lock the sash windows in the closed position.

The latch bolt is biased toward the side rails of the window frame. The side rails comprise a groove into which the latch bolt is biased so as to allow the window to slide up and down in the groove, but to prevent the window from tilting on its axis. When the lever is in the tiltable position, the rotor is adapted to engage the latch bolt and pull it away from the window frame rail so that the window may pivot on its axis into the tilted position.

In the lever's unlocked position, the rotor does not engage the keeper or the latch bolt. In this position, the window is free to slide up and down in the window frame, but it is not free to tilt on its axis since the latch bolt remains biased toward the window frame.

DESCRIPTION OF THE PREFERRED EMBODIMENT OF THE INVENTION

The present invention is a latch assembly 13 comprising a tilt latch mechanism and a sash lock mechanism for use with vinyl sash windows 15*a*, 15*b* that are slidable and tiltable within a master frame 10. The latch assembly 13 comprises a lever 28 which is movable among a first, a second, and a third position to adjust the assembly 13 among a respective locked, unlocked, and tiltable position. Although the present invention is described primarily herein as having two sash windows 15*a*, 15*b* within the master window frame 10, it should be noted that the present invention may be used with window assemblies having any number of sash windows within the master window frame 10.

Figure 1:
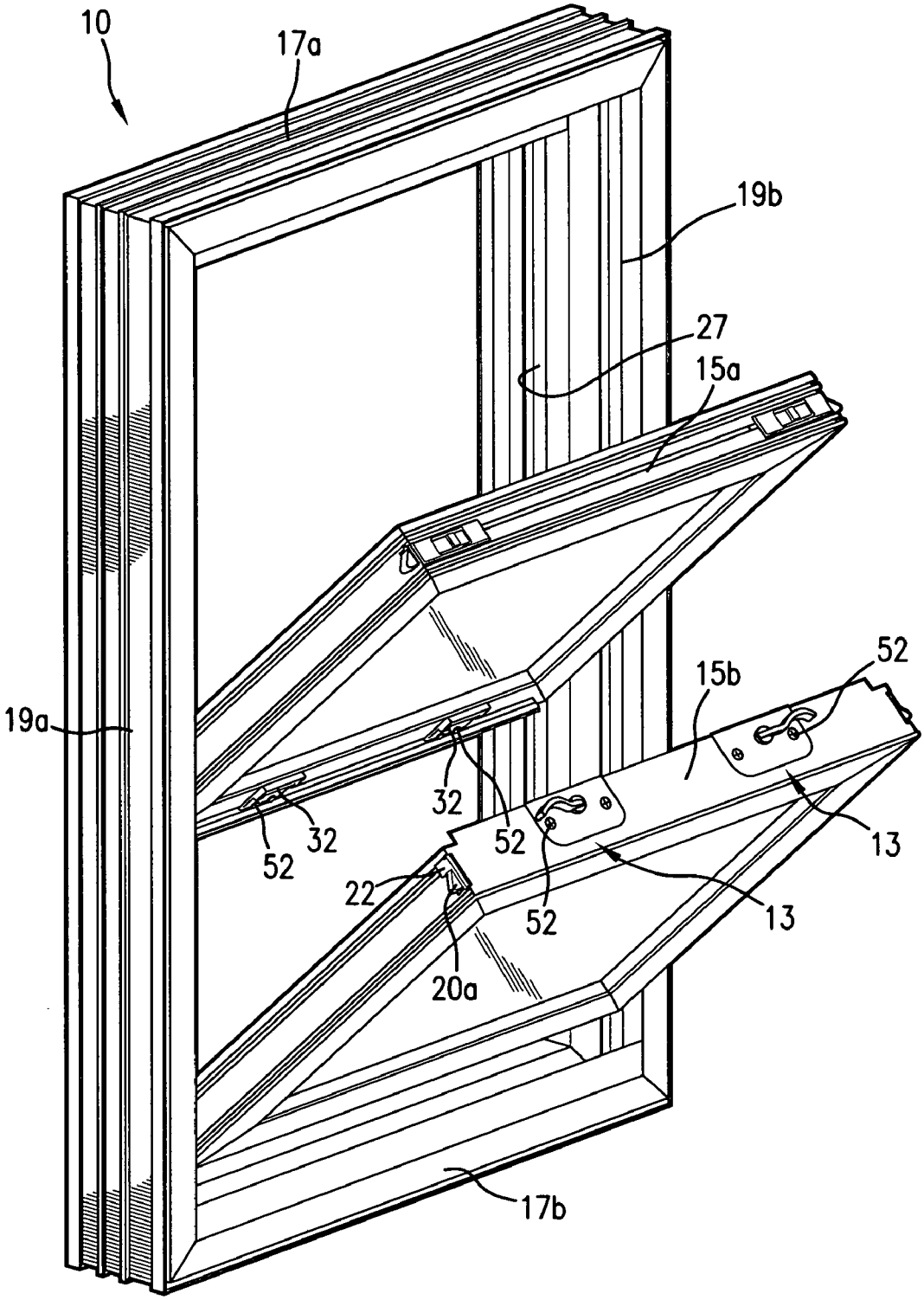
FIG. 1 is a perspective view of a sash window assembly in the tilted position.

FIG. 1 shows a window assembly having a master window frame 10 with two opposing sides 19*a*, 19*b*, a top 17*a*, and a bottom 17*b*. The inside portions of the opposing sides 19*a*, 19*b* have vertically extending guide rails 27 to enable vertical reciprocal sliding movement of the sash windows 15*a*, 15*b* which are cooperatively engaged with the guide rails 27. The upper sash window 15*a* has a sash frame and the lower sash window 15*b* has a sash frame. Attached to the lower edge of the upper window 15*a* sash frame is at least one keeper 32 while a latch assembly 13 is attached to an upper edge of the lower window 15*b* sash frame. To allow for tilting, the sash windows 15*a*, 15*b* are pivotally mounted in the master frame 10 at the base of the sash windows 15*a*, 15*b* as is known in the art FIGS. 2-7 show the latch assembly 13 of the present invention. The latch assembly 13 comprises a sash lock housing 34 and a latch bolt housing 22. The sash lock housing 34 is combined with the upper frame portion of the lower sash window 15*b*, by fasteners such as screws 52 or bolts as shown in FIG. 1. As is known in the art, vinyl windows have openings 50 (FIG. 7) in the sash window frames 15*a*, 15*b*. The latch bolt housing 22 combines with the upper frame portion of the lower sash window 15*b* by sliding into one of the openings 50 on the side of the vinyl sash window 15*b* frame. After being inserted into the sash window frame 15*b*, the latch bolt housing 22 is preferably combined with the frame by a tab 54 on the window 15*b* frame which snaps into groove 42 on the latch bolt housing 22. Tab 54 is shown in FIG. 7 inserted into groove 42. Groove 42 is shown without the tab 54 in FIGS. 2-6.

Figure 4:
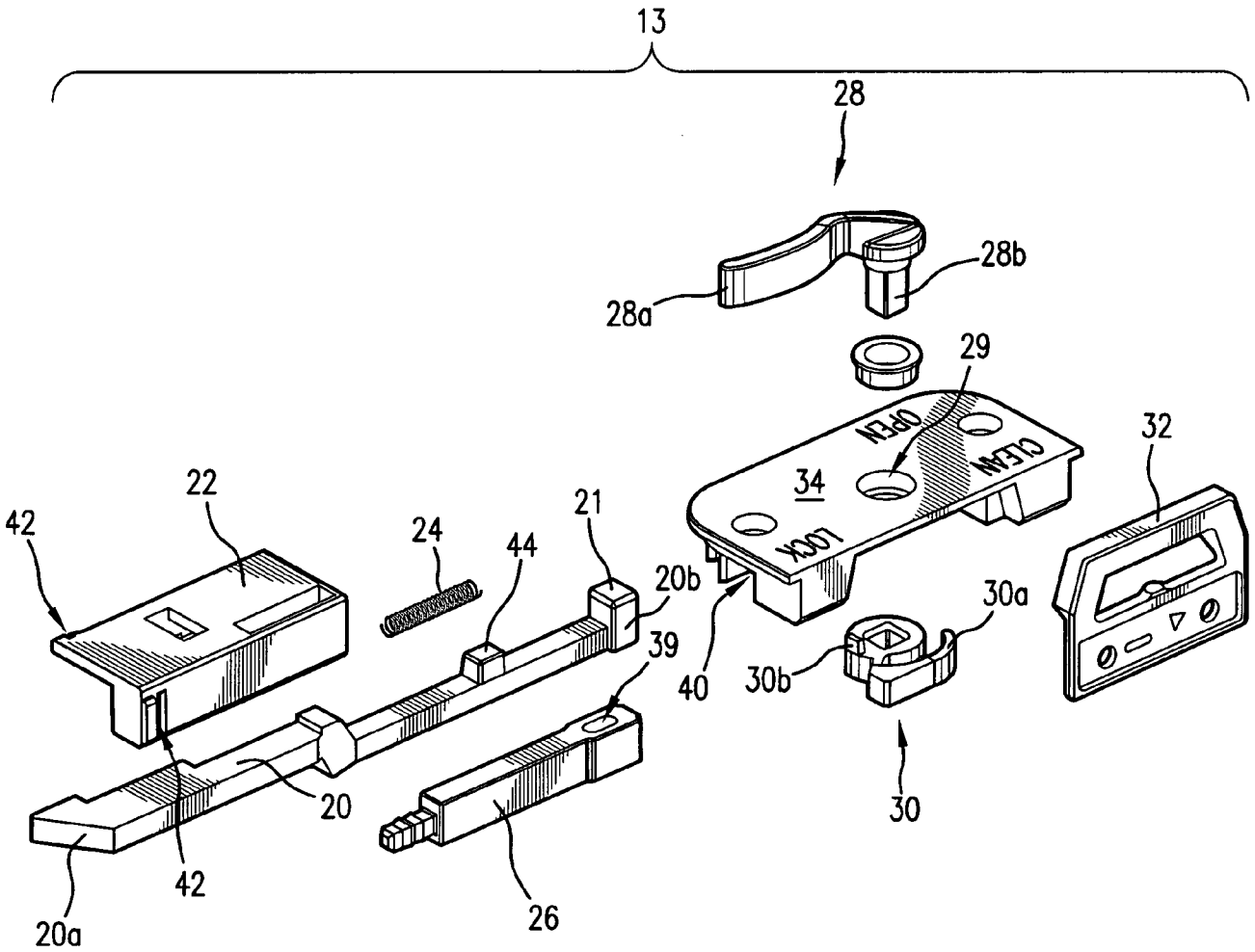
FIG. 4 is an exploded top view of the window latch assembly of the present invention.
Figure 5:
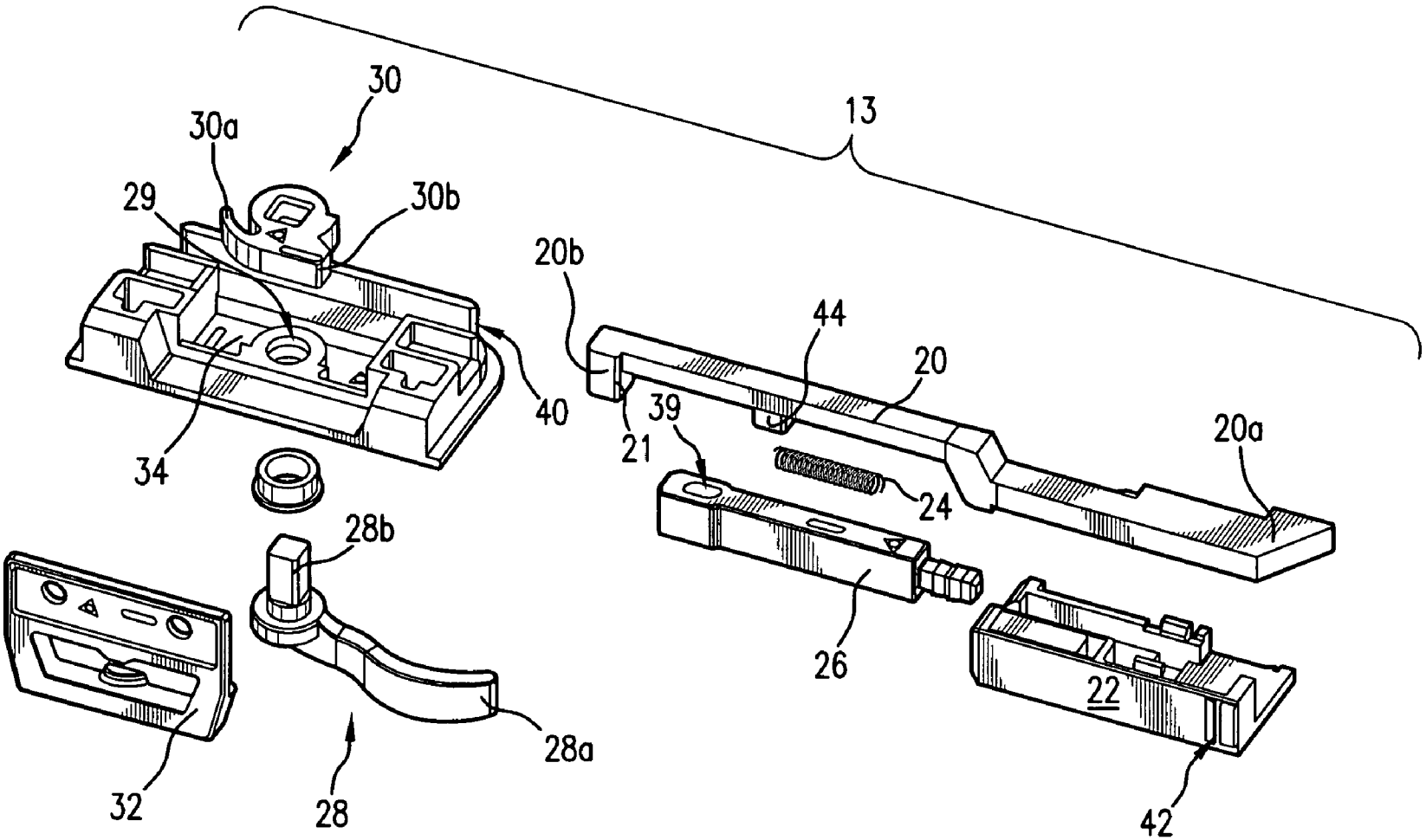
FIG. 5 is an exploded bottom view of the window latch assembly showing the channel adapted to receive the latch bolt.

As seen in FIGS. 4 and 5, the lever 28 comprises a handle end 28*a* and an extension end 28*b*. The sash lock housing 34 has an opening 29 adapted to receive the extension end 28*b* of the lever 28. The lever's 28 extension end 28*b* is inserted through the opening 29 in the sash lock housing 34 and combined with the rotor 30 on the underside of the housing 34 so that movement of the lever's 28 handle end 28*a* causes movement of the rotor 30.

Figure 2:
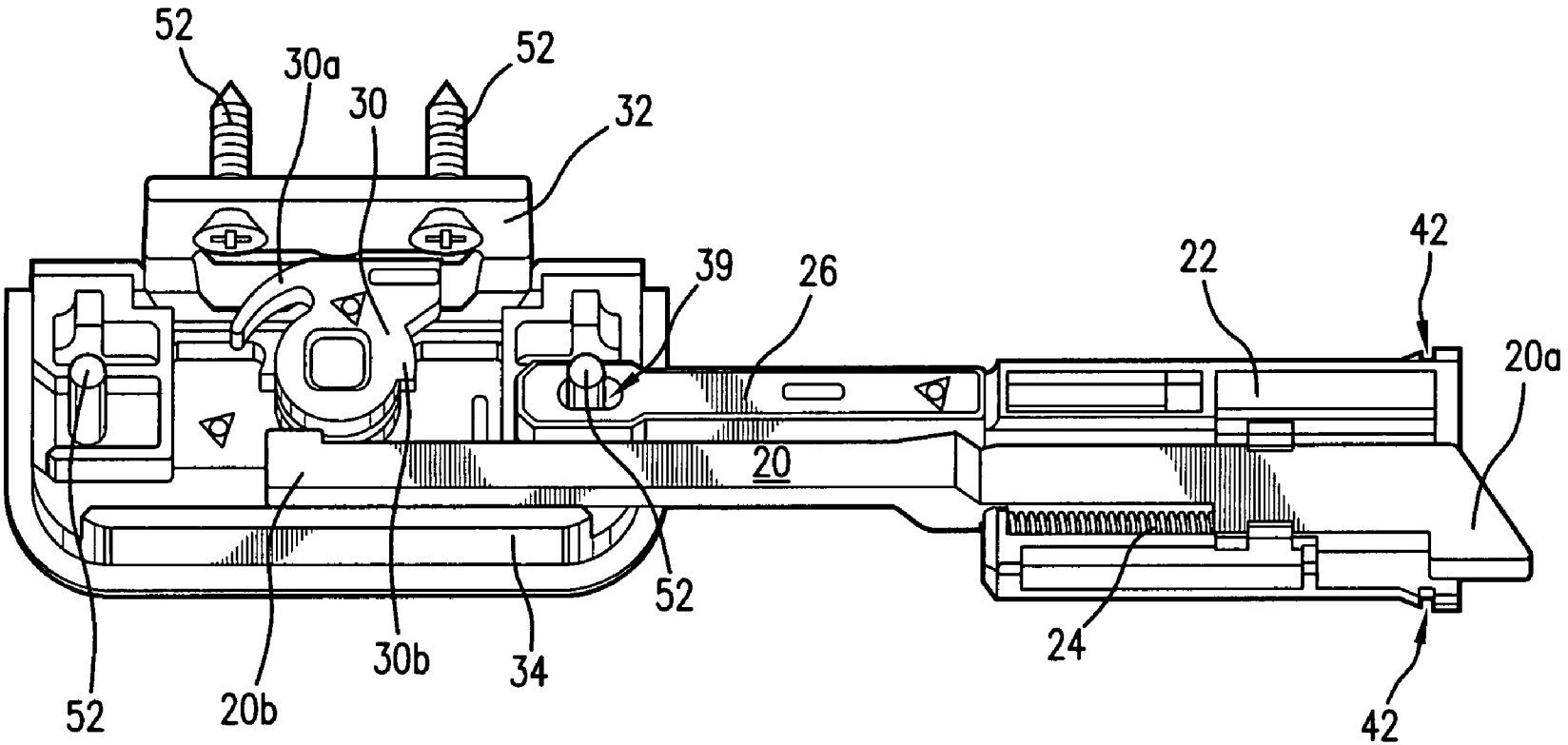
FIG. 2 is a bottom perspective view of the of the window latch assembly of the present invention showing the latch bolt in its outwardly biased position.
Figure 3:
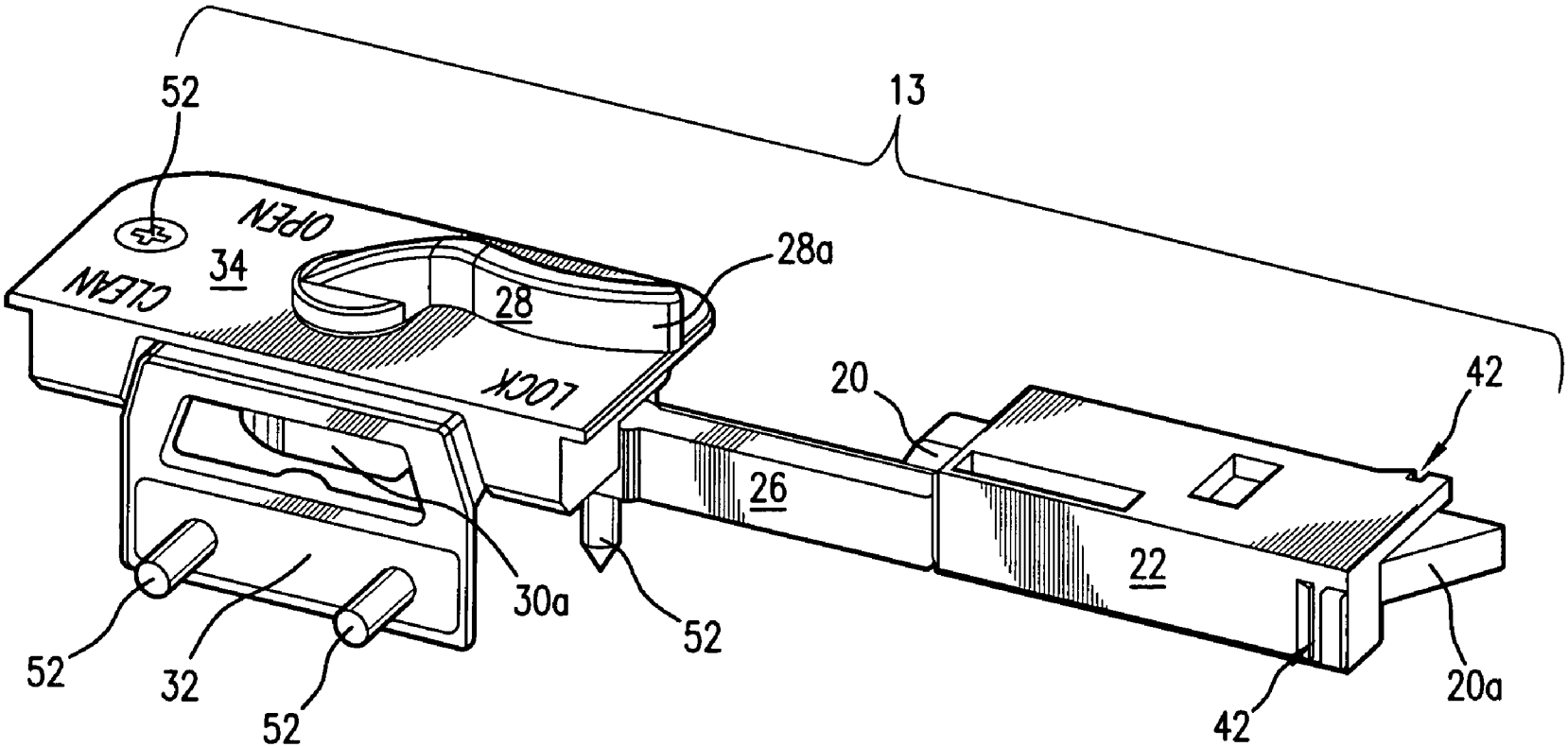
FIG. 3 is a perspective view of the window latch assembly of the present invention showing the rotor engaging the keeper in the locked position.

FIGS. 2, 4, and 5 show the rotor 30 comprising a first engagement portion 30*a* and a second engagement portion 30*b*. The first engagement portion 30*a* is adapted to engage the keeper 32 when the lever 28 is moved to its locked position and the second engagement portion 30*b* is adapted to engage and retract the latch bolt 20 when the lever 28 is moved to the tiltable position. More specifically, as the lever 28 is moved to the locked position, the rotor 30 rotates so that the first engagement portion 30*a* extends through the opening in the keeper 32, as is seen in FIG. 3. As discussed above, the keeper 32 is combined with the lower end of the upper sash window 15*a* and the latch assembly 13 is combined with the upper end of the lower sash window 15*b* so that when the rotor's 30 first engagement portion 30*a* extends through the opening in the keeper 32, the windows 15*a*, 15*b* cannot move upward or downward inside the master frame 10.

Figure 6:
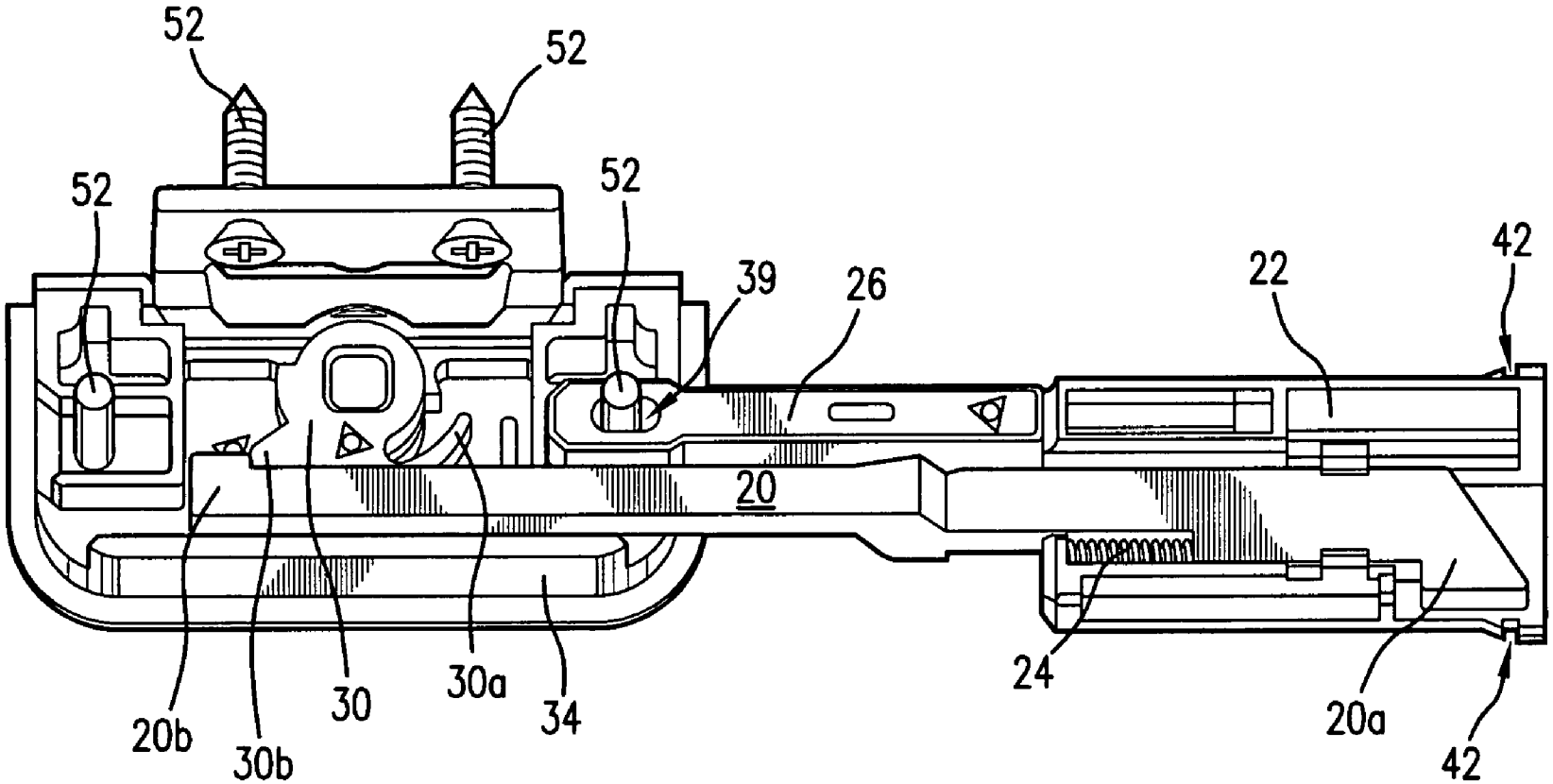
FIG. 6 is a perspective view similar to FIG. 2 showing the latch bolt in the retracted position.
Figure 7:
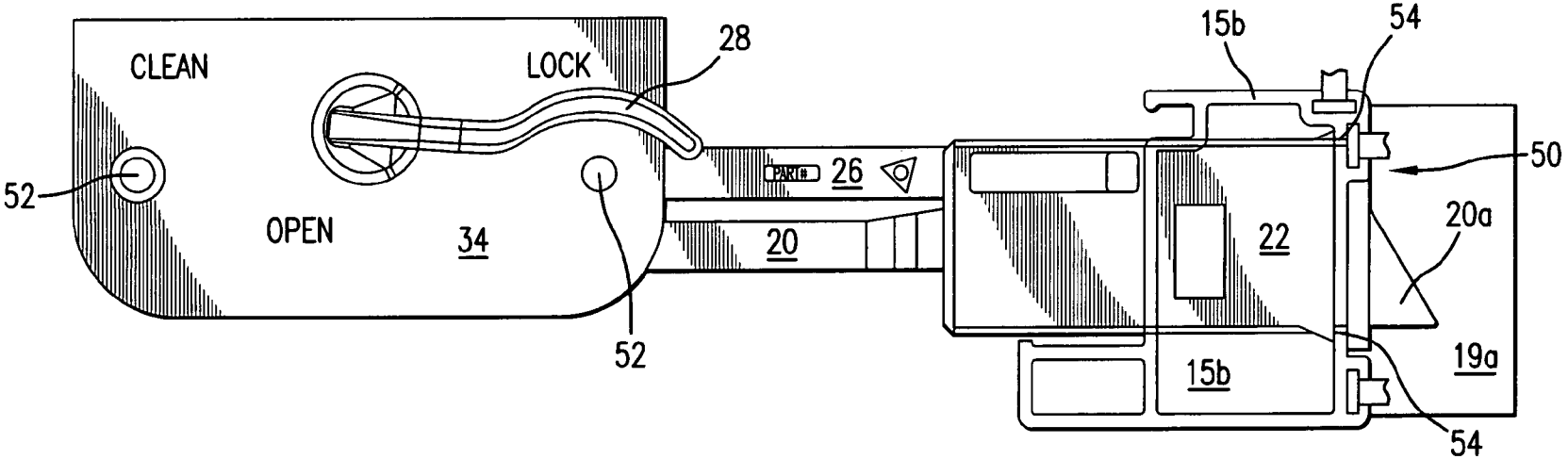
FIG. 7 is a top view showing the window latch assembly combined with a vinyl window frame.

As shown best in FIGS. 2, 4, and 6, the latch bolt 20 has a first end 20*a*, a second end 20*b*, and an engagement member 21. The engagement member 21 can be positioned anywhere along the length of the latch bolt 20, however, it is preferably positioned near the latch bolt second end 20*b*. The latch bolt 20 is biased toward and engages the guide rails 27 of the master frame 10 so as to prevent the window 15*b* from tilting on its axis. In the preferred embodiment, the latch bolt biasing means is a spring 24 which acts on a portion of the latch bolt 20 and biases it toward the guide rails 27. As the lever 28 is moved to the tiltable position, the rotor 30 acts as a cam. The rotor's second engagement portion 30*b* engages the latch bolt 20 at its engagement member 21 and pulls it away from the window frame 10. The latch bolt 20 is shown in its outwardly biased position in FIG. 2 and in its retracted position in FIG. 6. The lever 28 must be held in this tiltable position otherwise the spring 24 will push the latch bolt 20 back toward the guide rails 17. Once the latch bolt 20 is retracted from the guide rails 17 by the rotor 30, the sash window 15*b* can be titled on its axis for cleaning of the outside surface of the window or for any other desired purpose.

As seen in FIG. 5, the sash lock housing 34 has a channel 40 adapted to receive a portion of the latch bolt 20. The channel 40 supports the latch bolt 20 and keeps it from moving laterally as the windows 15*a*, 15*b* are moved to their respective open, closed, and tiltable positions. The latch bolt 20 preferably comprises an extension member 44 that helps to guide and support the latch bolt 20 through the channel 40. In addition to the extension member 44, the engagement member 21 of the latch bolt 20 helps to guide and support the latch bolt 20 through the channel 40.

FIGS. 2-4 show support member 26 which helps to combine the sash lock housing 34 and the latch bolt housing 22. The support member 26 provides structural support and rigidity to the latch assembly 13. In particular, the support member 26 provides support and strength transfer between the sash lock housing 34 and the latch bolt housing 22. The support member 26 has a circular or oblong shaped opening 39 which is adapted to receive the bolt or screw 52 that is used to combine the sash lock housing 34 with the sash window 15*b* frame. In the preferred embodiment the opening 39 is oblong so as to allow for a production tolerance when the screw 52 is inserted through the sash frame 15*b* and into the opening 39.

The latch assembly 13 of the present invention provides a simple and sturdy solution to the problems described in the Background section of this specification. In use, the lever 28 of the latch assembly 13 is movable among a first, a second, and a third position to adjust the assembly 13 among a respective locked, unlocked, and tiltable position. The lever 28 is combined with a rotor 30 which is adapted to engage the keeper 32 for selectively preventing the window 15*b* from opening when the lever 28 is in the locked position and the rotor 30 is engaged with the keeper 32. In the lever's tiltable position, the rotor 30 engages a latch bolt 20 and urges it away from the guide rails 27 so that the window may tilt on its axis. In the lever's 28 unlocked position, the rotor 30 does not engage the keeper 32 or the latch bolt 20 so the window is free to slide up and down in the window frame 10, but it is not free to tilt.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. An integrated tilt latch/sash lock assembly combined with a vinyl sash window assembly, the sash window assembly having an upper sash window and a lower sash window slidable within a master frame, the tilt latch/sash lock assembly comprising:

a sash lock assembly having a lever operably connected to a rotor wherein the lever is movable between a first, a second, and a third position to adjust the tilt latch/sash lock assembly among a respective locked, unlocked, and tiltable position;

a keeper adapted to be combined with the upper sash window so that movement of the lever to the first position causes a first portion of the rotor to engage the keeper and prevent the sash windows from moving within the master frame;

a tilt latch assembly having an outwardly biased latch bolt adapted to engage the master frame, wherein movement of the lever to the third position causes a second portion of the rotor to engage and retract the latch bolt so that the latch bolt is disengaged from the master frame;

a removable sash lock housing for the sash lock assembly wherein the sash lock housing is combined with the window by removable fasteners;

a removable latch bolt housing for the latch bolt assembly wherein the window is adapted to receive the latch bolt housing; and a support member having first and second ends, wherein the first end engages the sash lock housing, wherein the second end engages the latch bolt housing, and wherein the sash lock housing and sash lock assembly are separable from the support member.

2. The tilt latch/sash lock assembly of claim 1 wherein the lower sash window is made of vinyl.

3. The tilt latch/sash lock assembly of claim 2 wherein the lower vinyl sash window comprises an opening adapted to receive a portion of the tilt latch assembly.

4. The tilt latch/sash lock assembly of claim 2 wherein the sash lock housing has a channel adapted to receive a portion of the latch bolt.

5. The tilt latch/sash lock assembly of claim 4 wherein the latch bolt further comprises an extension member adapted to extend upward from the latch bolt and be received by the channel in the sash lock housing so as to help to guide the latch bolt as it moves through the channel.

6. The tilt latch/sash lock assembly of claim 4 wherein the sash lock housing is combined with the lower sash window with fasteners.

7. The tilt latch/sash lock assembly of claim 1 wherein the lower vinyl sash window further comprises at least one opening adapted to receive the latch bolt housing; and wherein the opening comprises as least one tab.

8. The tilt latch/sash lock assembly of claim 7 wherein the latch bolt housing further comprises at least one groove adapted to receive the tab which helps to secure the latch bolt housing to the lower sash window.

9. The tilt latch/sash lock assembly of claim 1 wherein a lower portion of the lower sash window is pivotally combined with the master frame so that movement of the lever to the third position allows the lower sash window to pivot on its axis.

* * * * *